US007972393B2

(12) United States Patent
Olliges

(10) Patent No.: US 7,972,393 B2
(45) **Date of Patent: *Jul. 5, 2011**

(54) COMPOSITIONS COMPRISING BORIC ACID

(75) Inventor: William E. Olliges, Palm City, FL (US)

(73) Assignee: Advanced Lubrication Technology, Inc., Westlake Village, CA (US)

( * ) Notice: Subject to any disclaimer, the term of this patent is extended or adjusted under 35 U.S.C. 154(b) by 647 days.

This patent is subject to a terminal disclaimer.

(21) Appl. No.: 12/030,941

(22) Filed: Feb. 14, 2008

(65) Prior Publication Data

US 2008/0200356 A1 Aug. 21, 2008

Related U.S. Application Data

(63) Continuation-in-part of application No. 11/201,941, filed on Aug. 10, 2005, now Pat. No. 7,419,515, and a continuation-in-part of application No. 11/201,942, filed on Aug. 10, 2005, now Pat. No. 7,494,959.

(51) Int. Cl.
*C10L 1/12* (2006.01)
*C10L 1/18* (2006.01)

(52) U.S. Cl. ..... 44/314; 44/301; 44/302; 44/451; 44/452

(58) Field of Classification Search ..... 44/314, 44/301, 302, 451, 452
See application file for complete search history.

(56) References Cited

U.S. PATENT DOCUMENTS

| | | | |
|---|---|---|---|
| 2,614,985 | A | 10/1952 | Cook |
| 2,987,476 | A | 6/1961 | Whitbey et al. |
| 3,002,826 | A | 10/1961 | Norris |
| 3,829,381 | A | 8/1974 | Le Suer |
| 3,907,691 | A | 9/1975 | King et al. |
| 3,997,454 | A | 12/1976 | Adams |
| 4,298,482 | A | 11/1981 | Cheng et al. |
| 4,448,701 | A | 5/1984 | Duerksen et al. |
| 4,504,276 | A | 3/1985 | Baker |
| 4,626,367 | A | 12/1986 | Kuwamoto et al. |
| 4,636,326 | A | 1/1987 | Hernandez |
| 4,690,687 | A | 9/1987 | Johnston et al. |
| 4,846,985 | A | 7/1989 | Rizvi et al. |
| 5,431,830 | A | 7/1995 | Erdemir |
| 5,512,198 | A | 4/1996 | Sasaki et al. |
| 5,739,088 | A | 4/1998 | Inoue et al. |
| 5,877,129 | A | 3/1999 | Yatsuzukza et al. |
| 6,025,306 | A | 2/2000 | Erdemir |
| 6,162,769 | A | 12/2000 | Polhaar et al. |

(Continued)

FOREIGN PATENT DOCUMENTS

DE 19703085 A1 7/1998

(Continued)

OTHER PUBLICATIONS

Jackson, M. M, et al., "Study of Diesel and Ethanol Blends Stability," SAE International, 2003.

(Continued)

*Primary Examiner* — Cephia D Toomer

(74) *Attorney, Agent, or Firm* — Cahn & Samuels, LLP

(57) ABSTRACT

A multiphase distillate fuel composition includes an emulsion comprising a first phase comprising a diesel fuel; a second phase comprising glycerol and boric acid; and a surfactant. A lubricant composition includes a grease and a mixture of boric acid with different particle sizes.

9 Claims, 4 Drawing Sheets

U.S. PATENT DOCUMENTS

| | | | | |
|---|---|---|---|---|
| 6,245,723 | B1 | 6/2001 | Sigg | |
| 6,368,369 | B1 | 4/2002 | Sandiya et al. | |
| 6,472,352 | B1 | 10/2002 | Hacias | |
| 6,642,189 | B2 | 11/2003 | Kurihara et al. | |
| 6,645,262 | B1 | 11/2003 | Sandiya et al. | |
| 6,774,091 | B2 | 8/2004 | Dituro et al. | |
| 6,783,561 | B2 * | 8/2004 | Erdemir | 44/314 |
| 7,419,515 | B2 * | 9/2008 | Olliges | 44/314 |
| 7,547,330 | B2 * | 6/2009 | Erdemir | 44/314 |
| 2003/0045435 | A1 | 3/2003 | Erdemir | |
| 2005/0009712 | A1 | 1/2005 | Erdemir | |
| 2007/0033862 | A1 | 2/2007 | Olliges | |
| 2007/0037714 | A1 | 2/2007 | Olliges | |
| 2011/0015104 | A1 | 1/2011 | Olliges | |

FOREIGN PATENT DOCUMENTS

| | | | |
|---|---|---|---|
| EP | 0206833 | A | 12/1986 |
| EP | 0 207 560 | A1 | 1/1987 |
| EP | 0 288 296 | A1 | 10/1988 |
| EP | 0403205 | A | 12/1990 |
| FR | 1559468 | A | 3/1969 |
| FR | 2 277 881 | A1 | 2/1976 |
| GB | 191307807 | A | 0/1914 |
| GB | 434 109 | A | 8/1935 |
| GB | 943 777 | A | 12/1963 |
| GB | 964 184 | A | 7/1964 |
| GB | 1169667 | A | 11/1969 |
| GB | 1202386 | A | 8/1970 |
| GB | 1 307 127 | A | 2/1973 |
| GB | 2 091 291 | A | 7/1982 |
| GB | 2 173 419 | A | 10/1986 |
| WO | 8701126 | | 2/1987 |
| WO | 0153435 | A2 | 7/2001 |

OTHER PUBLICATIONS

English Abstract of DE 19703085, Jul. 1998.
Office Action in Chinese Patent Application No. 200680037745.9 dated Jan. 6, 2011.

* cited by examiner

COMPOSITIONS COMPRISING BORIC ACID

The present application is a Continuation-In-Part patent application of U.S. Ser. No. 11/201,941 filed Aug. 10, 2005, now U.S. Pat. No. 7,419,515, and of U.S. Ser. No. 11/201,942 filed Aug. 10, 2005, now U.S. Pat. No. 7,494,959, the entireties of which are both incorporated herein by reference.

FIELD OF THE INVENTION

The present invention relates to compositions comprising boric acid, for example, a multiphase distillate fuel emulsion composition or a grease composition.

Boric acid is environmentally safe, inexpensive, and has an unusual capacity to enhance the antifriction and antiwear properties of sliding metal surfaces. Boric acid is a crystalline compound, insoluble in hydrocarbons such as distillate fuels.

SUMMARY OF THE INVENTION

According to an aspect of the present invention, a multiphase distillate fuel composition is provided including an emulsion comprising a first phase comprising a diesel fuel; a second phase comprising glycerol and boric acid; and a surfactant.

According to another aspect of the invention, a lubricant composition is provided comprising a grease and a mixture of boric acid with different particle sizes.

As used herein "substantially", "relatively", "generally", "about", and "approximately" are relative modifiers intended to indicate permissible variation from the characteristic so modified. They are not intended to be limited to the absolute value or characteristic which it modifies but rather approaching or approximating such a physical or functional characteristic.

In the detailed description, references to "one embodiment", "an embodiment", or "in embodiments" mean that the feature being referred to is included in at least one embodiment of the invention. Moreover, separate references to "one embodiment", "an embodiment", or "in embodiments" do not necessarily refer to the same embodiment; however, neither are such embodiments mutually exclusive, unless so stated, and except as will be readily apparent to those skilled in the art. Thus, the invention can include any variety of combinations and/or integrations of the embodiments described herein.

Given the following enabling description of the drawings, the method should become evident to a person of ordinary skill in the art.

DETAILED DESCRIPTION OF THE INVENTION

Figure 1:
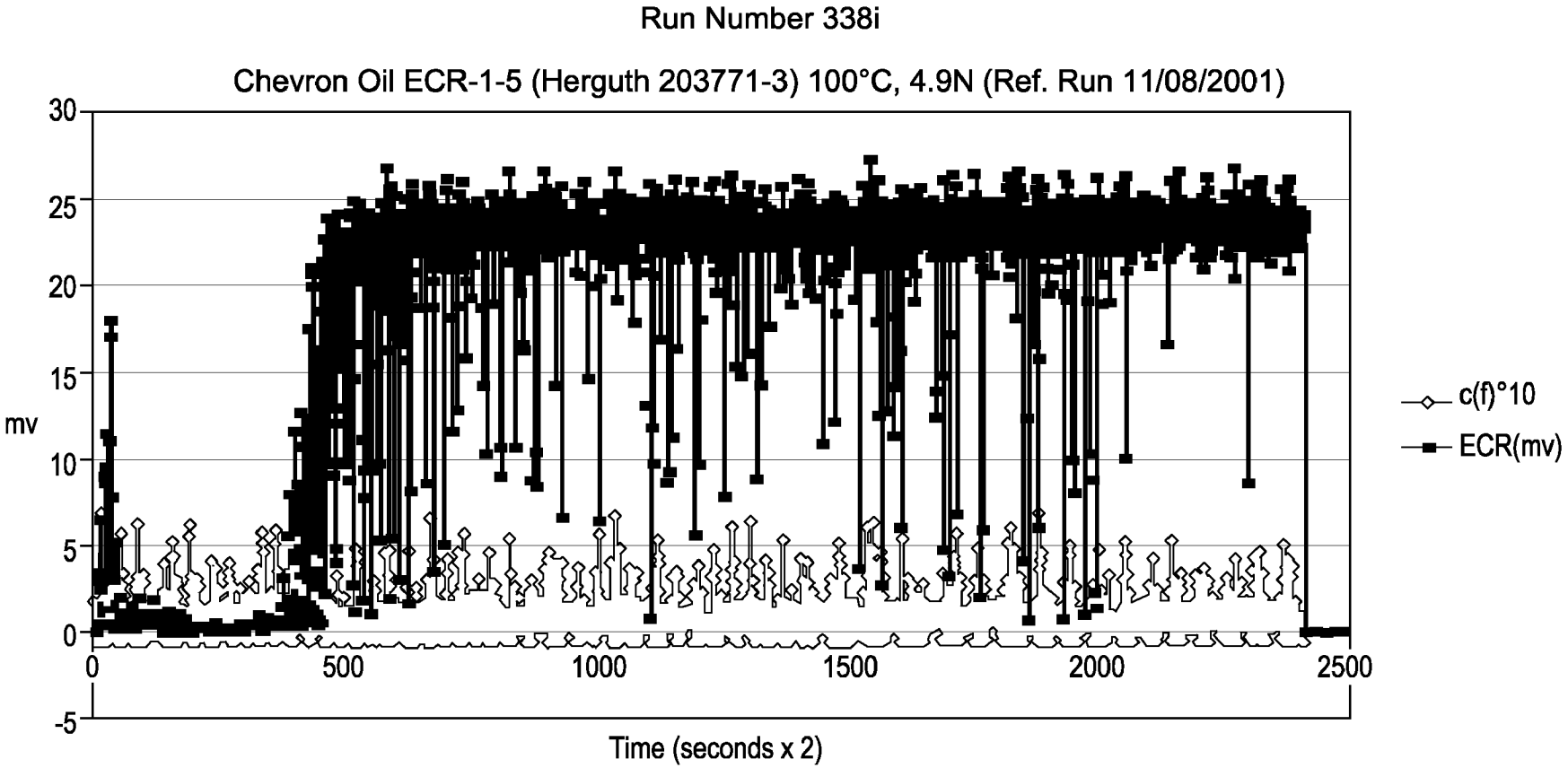
FIG. 1 is a graph illustrating electrical properties of a reference SAE 30 motor oil.

The present invention relates compositions comprising boric acid, for example, a multiphase distillate fuel emulsion composition or a grease composition.

A. Multiphase Emulsion Composition

According to the present invention, a multiphase emulsion composition comprises (1) a first phase comprising a distillate fuel or lubricant; and (2) a second phase comprising boric acid and a liquid solvent for boric acid, but which is immiscible in the first phase; and (3) a surfactant.

The distillate fuel may include, but is not limited to, diesel fuel and, in particular, low sulfur (i.e., less than 0.05 mass percent sulfur) diesel fuel, jet fuel, kerosene, and mixtures of these fuels. The distillate fuel, itself, may be a conventional petroleum distillate or may be synthesized, e.g., by the Fischer-Tropsh method or the like.

The lubricant may include, but is not limited to, engine oils, hydraulic fluids, transmission fluids, cutting oils, machine oils, metal press forming oils, chain lubricating oils, metal working fluids, mold release fluids, synthetic oils, and greases.

The boric acid typically has a particle size of 100 microns or less. In embodiments, the boric acid may have a particle size of about 1 micron to about 65 microns, for example, about 5 to about 25 microns. In additional embodiments, the boric acid may have a particle size from about 0.1 to about 5 microns, for example, from about 0.5 to about 1 micron. The boric acid particles may be produced by the low temperature jet-milling of commercially available boric acid.

Suitable liquids that are a solvent for the boric acid, but immiscible in the first phase, must be compatible with the distillate fuel or lubricant. Representative organic liquids include, but are not limited to, lower alkyl polyols comprising from 3 to 7 carbon atoms and at least three hydroxyl groups; ethyl acetate; acetone; acetic acid; alcohols such as methanol, ethanol, 1-propanol, 2-methyl-1-propanol, and 3-methyl-1-butanol; and glycerol. Suitable inorganic liquids include water.

The amount of boric acid in the second phase is dependent on the solubility of the boric acid. It is generally desirable to add sufficient boric to saturate the second phase. Typically, the second phase contains from about 10 to about 40 wt. %, boric acid and from about 90 to about 60 wt. %, liquid solvent, based on the weight of the second phase.

A composition may contain a relatively high concentration of the second phase. The amount of distillate fuel or lubricant is generally from about 30 to about 70 wt. %, preferably from about 45 to about 55 wt. %, based on the weight of the composition. The amount of the second phase is generally from about 30 to about 70 wt. %, preferably from about 45 to about 55 wt. %, based on the weight of the composition.

In embodiments, the amount of boric acid in the composition may be from about 1 wt. % to about 30 wt. %, preferably about 5 wt. % to about 20 wt. %, and more preferably about 10 wt. % to about 15 wt. %, based on the weight of the composition.

According to the present invention, the multiphase emulsion compositions comprise a surfactant in an amount sufficient to stabilize the first and second phases, generally from about 0.5 to about 1.5 wt. %, based on the weight of the composition.

Suitable surfactants include, but are not limited to, tristyrylphenol ethoxylates, for example Soprophor TS-10 (Rhone Poulenc S. A.) or BSU (Rhodia Geronazzo Spa), EO/PO/EO block copolymers, for example Pluronic F-108, Pluronic F-38, Pluronic P-105 (BASF Wyandotte Corp.), and/or sodium salts of sulfonated naphthalenesulfonic acid-formaldehyde condensation products, for example Morwet D-425 (Witco Chem. Corp.) or Orotan SN (Rohm & Haas, France S. A.), lignosulfonates, PO/EO butanol copolymers, for example Atlox G-5000, block copolymers of polyhydroxystearic acid and polyalkylene glycols, for example Atlox 4912 or 4914 (Uniqema), or partially hydrolysed or fully hydrolysed polyvinyl acetate, for example Mowiol 18-88 or Mowiol 4-88 (Hoechst AG).

In particular embodiments, multiphase distillate fuel compositions comprising an emulsion of diesel fuel and boric acid/glycerol have advantages. Such advantages include improved electrical properties, suppression and/or decomposition of hydroperoxides, and reduction of particulate emissions.

A benefit of a glycerol-based boric acid emulsion is its improved electrical insulating properties, which reduces electrostatic spark generation in fuel formations.

Figure 2:
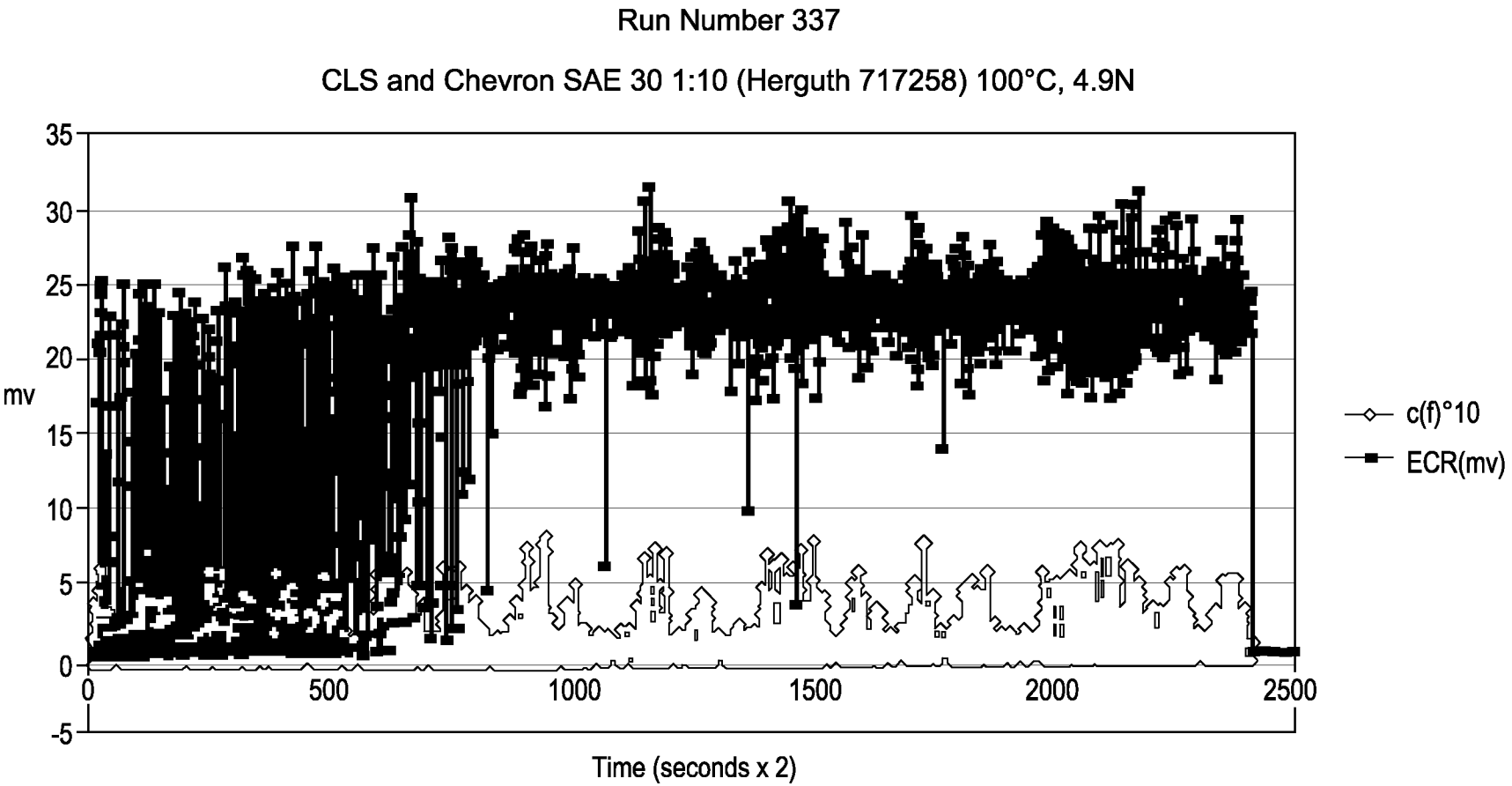
FIG. 2 is a graph illustrating electrical properties of SAE 30 motor oil with a Motor Silk™ additive comprising boric acid.
Figure 3:
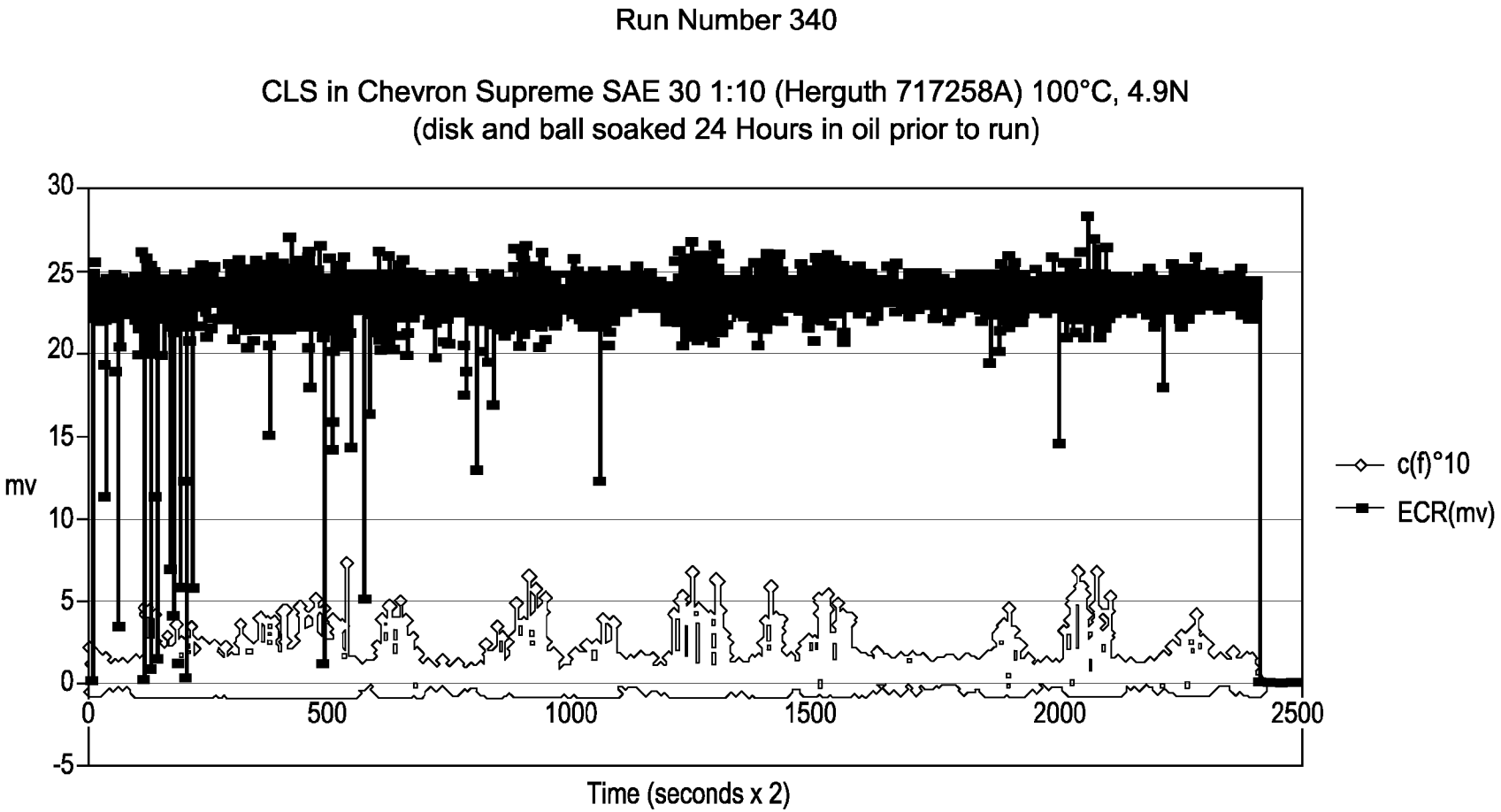
FIG. 3 is a graph illustrating properties of SAE 30 motor oil with a Motor Silk™ additive comprising boric acid after the measurement apparatus has been soaked in the composition for 24 hours.

As illustrated in FIGS. 1-3, Motor Silk™ (a submicron boric acid additive) forms a protective antiwear film quickly on a metal surface. Although FIGS. 1-3 illustrate boric acid dispersed in a fuel, similar properties apply to an emulsion comprising fuel and boric acid dissolved in glycerol.

Using a technique known as Electrical Contact Resistance (ECR), a small voltage is applied to a steel pin. Initially, this pin is in contact with a grounded steel disk completing an electrical circuit. As the disk rotates with the pin riding on the surface under load, in an oil bath, film(s) form and act as an electrical insulator. The electrical contact (or lack of contact) is recorded using data acquisition software every few seconds.

As shown in FIG. 1, a first test was a reference oil alone (Chevron SAE 30). The time it took to insulate the contact was about 187 seconds.

As shown in FIG. 2, a second test was the reference Chevron SAE 30 with Motor Silk™ added. In this test a majority of the insulating film was formed immediately.

As shown in FIG. 3, a third test was performed on a pin and disk pair that had been soaked for 24 hours in a blend of Motor Silk™ and Chevron reference oil. As can be seen, a film had formed simply by soaking the pin and disk.

The data points on the top of FIGS. 1-3 represent the electrical contact between the pin and disk. When the data point is at the bottom (downward motion) the pin and disk are in electrical contact. When the data points are at the top of the graph there is insulation (film formed). As can be seen there is sporadic contact as the data point shifts rapidly from top to bottom. This represents a film that is not completely covering the contact and has an occasional area that is "unprotected". The Motor Silk™ not only formed a film faster, but as evidenced by the stability of the data points, the film was more effective than the reference oil SAE 30.

The lower points in FIGS. 1-3 represent the coefficient of friction. It appears that the coefficient of friction decreases with the use of Motor Silk™.

Another benefit of a glycerol-based boric acid diesel emulsion is control of hydroperoxides normally generated in ultra low sulfur diesel fuel. Hydroperoxides have a corrosive effect on many fuel systems.

Figure 4:
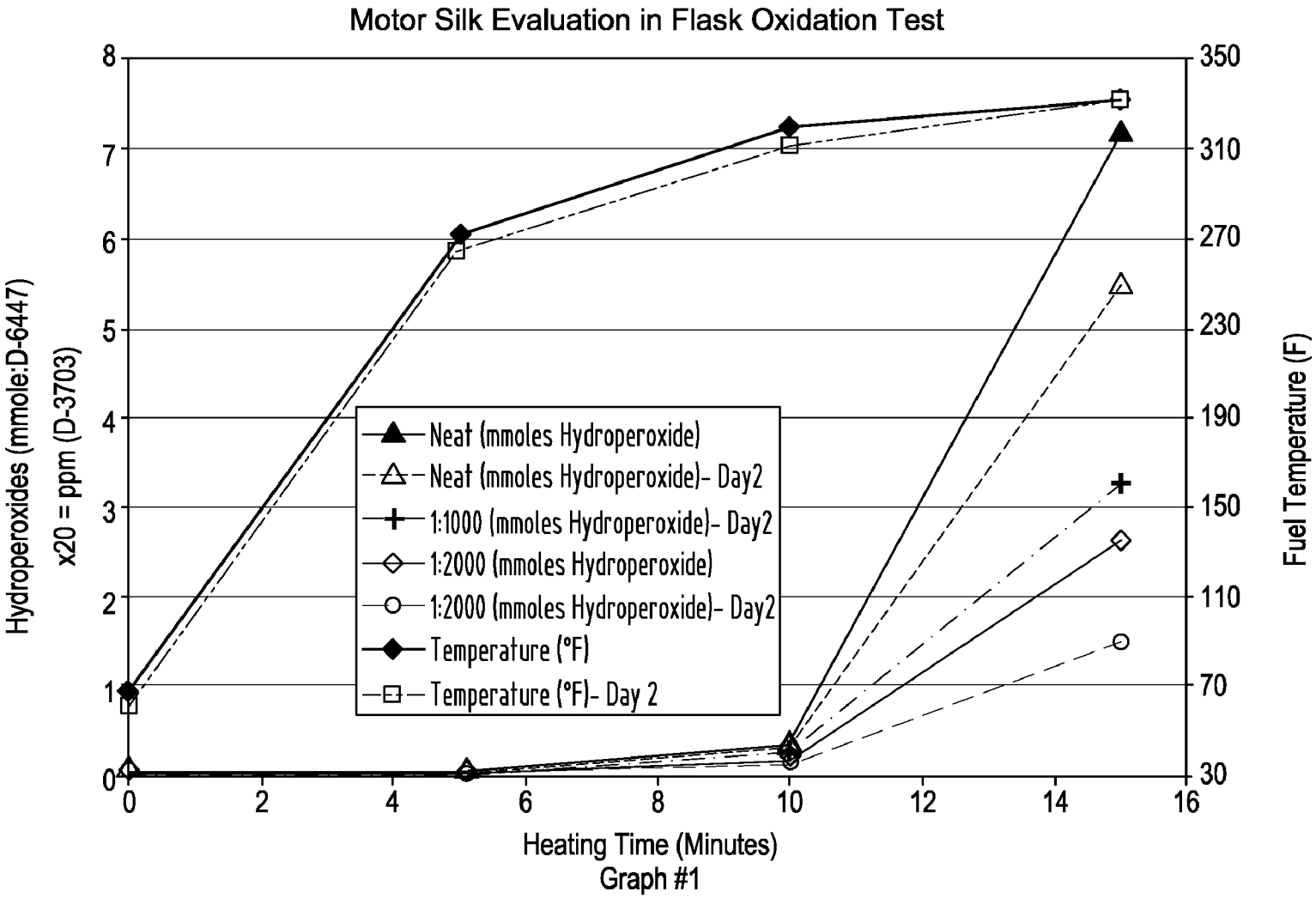
FIG. 4 is a graph illustrating hydroperoxide concentration for a diesel fuel and a diesel fuel with a Motor Silk™ additive.

The Motor Silk™ additive has hydroperoxide inhibition capability and acts as a hydroperoxide decomposer instead of blocking production, as illustrated in FIG. 4. Although FIG. 4 illustrates boric acid dispersed in a fuel, similar properties apply to an emulsion comprising fuel and boric acid dissolved in glycerol.

FIG. 4 is a graph showing that increasing a Motor Silk™ additive concentration from 1:1000 and 1:2000 has some hydroperoxide inhibition capability but is unable to stop accelerated oxidation of fuel at elevated temperatures. Motor Silk™ reduces the generation of hydroperoxides in heated diesel fuel by about 68% for the 1:2000 mix and by about 50% for the 1:1000 mix.

| | | |
|---|---|---|
| Neat Fuel 1$^{st}$ | 1:2000 1$^{st}$ Run Motor | 1:1000 1$^{st}$ Run Motor |
| Run = 1440 | Silk = 520 | Silk = 640 |
| Neat Fuel 1$^{st}$ | 1:2000 2$^{nd}$ Run Motor | — |
| Run = 1100 | Silk = 300 | |
| Average Neat = 1270 | 1:2000 Average = 410 | 1:1000 Average = 640 |

The second run was about 5-10° F. cooler than the first run.

The distillate fuel compositions can contain other conventional fuel additives. Representative additives include antioxidants, metal passivators, rust inhibitors, dispersants, detergents, and the like. The distillate fuel compositions also can contain additional lubricity-enhancing agents, such as stearic acid.

The lubricant compositions can also contain one or more conventional lubricant additives. For example, the lubricant compositions can be used in the formulation of high temperature ovens or in aluminum extrusion operations, together with selected lubricant additives. Suitable additives include, but are not limited to, antioxidants, metal inactivators, thickeners, anti-wear agents, and extreme pressure agents, as well as viscosity index improvers, dispersants, anti-emulsifying agents, color stabilizers, detergents, rust preventatives, and pour point depressants.

The multiphase compositions may be made by mixing the boric acid, the liquid, and the surfactant in a high shear blender until a homogeneous mixture is obtained. Optionally, at this time, other conventional additives can be added. Generally, the ingredients are blended at a temperature of about 150° F. However, the blending can also be done also at higher and lower temperatures, with higher temperatures being preferred to lower temperatures, because of the ease of forming the homogeneous solution. The mixture is then slowly cooled to room temperature.

To this mixture is slowly added the distillate fuel or lubricant, either in an amount to form a concentrate or to form the composition. During the addition and, preferably, for a time after, the multiphase composition is mixed with a high shear blender until a stable emulsion is formed.

B. Grease Composition

According to the present invention, a lubricant comprising a natural or synthetic grease may comprise boric acid dispersed therein.

The boric acid typically has a particle size of 100 microns or less. In embodiments, the boric acid may have a particle size of about 1 micron to about 65 microns, for example, about 5 to about 25 microns. In additional embodiments, the boric acid may have a particle size in the range of from about 0.1 to about 5 microns, for example, from about 0.5 to about 1 micron. The boric acid particles may be produced by the low temperature jet-milling of commercially available boric acid.

In embodiments, the amount of boric acid in the composition may be from about 1 wt. % to about 30 wt. %, preferably about 5 wt. % to about 20 wt. %, and more preferably about 10 wt. % to about 15 wt. %, based on the weight of the composition.

According to the present invention, the grease containing boric acid, for example submicron boric acid particles, provides exceptional protection at a metal surface after reaction with the boric acid forms boric oxide. The boric acid particles in the grease product are dispersed throughout the grease and are held in place by the semisolid nature of grease.

In embodiments, a combination or mixture of boric acid particles may be used. For example, a mixture of boric acid having a particle size of about 65 microns and boric acid having a particle size of about 1 microns may be used. The different size boric acid particles may be better in filling in asperities in a surface.

In embodiments, the grease may comprise at least one additive. Additives include, but are not limited to, at least one of a solubility improver, extreme pressure additive, rust inhibitor, other lubricant, such as polytetrafluoroethylene, or a filler.

In particular, PTFE may be used in a grease composition according to the present invention so that the PTFE provides an initial lubricating effect until the boric acid forms boric oxide. In embodiments, a fumed silica filler is advantageous as it has a high flash point and may be suitable for high temperature applications. Also, an extreme pressure agent, such as non-chlorinated Ferro NCEP, may be added to the grease to improve oxidation and stability.

The following example is intended to further illustrate the invention and is not a limitation thereon.

EXAMPLE

Lubrisilk ™ Grease Product

| Component | % By Wt |
|---|---|
| Exxon/Mobil Spectrasyn 6 | 45.0 |
| Exxon/Mobil Ultrasyn 300 | 16.0 |
| Boric Acid (65 Micron) | 6.0 |
| Boric Acid (1 Micron) | 6.0 |
| Ferro Ncep | 2.0 |
| Adipic Acid (By Wright) | 2.0 |
| PTFE | 2.0 |
| Tackifier (By Wright) | 8.0 |
| King AO-150 (Or AO-130) | 1.0 |
| Ferro Plas-Chek 775 | 1.0 |
| King AO-240 (AO-242) | 0.5 |
| King Nasul 729 | 0.5 |
| CABOT TS-720 | 10.0 |

The grease product is made by adding PAO base first then adding all other ingredients except Cabot thickener and tackifier. Run mixture thru mill and external pump back into kettle smooth with no particles observed. Then slowly add Cabot TS-720 allowing it to mix/dissolve. After obtaining penetration within 0.1# of specified grade, add tackifier and mix thoroughly with mill without overshearing. The mill is then by-passed and product is run thru external pump for packaging.

While various embodiments of the present invention have been described above, it should be understood that they have been presented by way of example only, and not limitation. It will be understood by those skilled in the art that various changes in form and details can be made therein without departing from the spirit and scope of the invention as defined in the appended claims. Thus, the breadth and scope of the present invention should not be limited by any of the above-described exemplary embodiments, but should be defined only in accordance with the following claims and their equivalents.

What is claimed is:

1. A multiphase distillate fuel composition comprising an emulsion comprising a first phase comprising a diesel fuel; a second phase comprising glycerol and boric acid; and a surfactant.

2. A multiphase distillate fuel composition according to claim 1, wherein the boric acid has a particle size of 100 microns or less.

3. A multiphase distillate fuel composition according to claim 1, wherein the boric acid has a particle size of about 5 microns to 25 microns.

4. A multiphase distillate fuel composition according to claim 1, wherein the boric acid has a particle size of about 0.5 to about 1 micron.

5. A multiphase distillate fuel composition according to claim 1, wherein the boric acid has a particle size of about 0.1 to about 0.5 micron.

6. A multiphase distillate fuel composition according to claim 1, wherein the emulsion comprises about 5 to about 20 wt. % of boric acid, based upon the weight of the composition.

7. A multiphase distillate fuel composition according to claim 1, wherein the emulsion comprises about 10 to about 15 wt. % of boric acid, based upon the weight of the composition.

8. A multiphase distillate fuel composition according to claim 1, wherein an electrically-insulating film is formed.

9. A method for inhibiting hydroperoxide formation in a diesel fuel, comprising:

dissolving boric acid in glycerol; and adding the boric acid/glycerol to a diesel fuel, thereby forming an emulsion.

* * * * *